United States Patent [19]

Johnson et al.

[11] Patent Number: 4,955,397

[45] Date of Patent: Sep. 11, 1990

[54] CIGARETTE

[75] Inventors: Robert R. Johnson; Jiunn-Yann Tang, both of Louisville, Ky.

[73] Assignee: Brown & Williamson Tobacco Corporation, Louisville, Ky.

[21] Appl. No.: 378,351

[22] Filed: Jul. 10, 1989

[51] Int. Cl.[5] ..... A24D 3/04; A24B 15/00

[52] U.S. Cl. ..... 131/194; 131/335; 131/340; 131/359

[58] Field of Search ..... 131/359, 360, 331, 335, 131/336, 364, 194, 339, 340

[56] References Cited

U.S. PATENT DOCUMENTS

| | | | |
|---|---|---|---|
| 3,258,015 | 6/1966 | Ellis et al. . | |
| 3,614,956 | 10/1971 | Thornton | 131/331 |
| 4,219,031 | 8/1980 | Rainer et al. . | |
| 4,273,141 | 6/1981 | Van Tilburg | 131/336 |
| 4,453,553 | 6/1984 | Cohn | 131/365 |
| 4,474,191 | 10/1984 | Steiner | 131/198.2 |
| 4,480,650 | 11/1984 | Weinert | 131/365 X |
| 4,649,941 | 3/1987 | Norman et al. | 131/339 X |
| 4,771,795 | 9/1988 | White et al. | 131/335 |

*Primary Examiner*—V. Millin
*Assistant Examiner*—J. L. Doyle
*Attorney, Agent, or Firm*—Charles G. Lamb

[57] ABSTRACT

A cigarette including a tobacco rod circumscribed by a metal foil wrapper and having a cylinder of carbon fuel surrounding the metal foil wrapper tobacco rod. An air permeable outer wrapper circumscribes the cylinder of carbon fuel. A filter plug is located at one end of the cigarette.

10 Claims, 1 Drawing Sheet

CIGARETTE

BACKGROUND OF THE INVENTION

The present invention relates to cigarettes, and more particularly to a cigarette having a centrally disposed tobacco column surrounded by a cylinder of non-tobacco fuel.

Smoking articles having an inner rod of a non-burning nicotine flavor releasing material surrounded by a fuel are, per se, known.

For example, U.S. Pat. No. 3,258,015 issued on Jun. 28, 1966 to C. D. Ellis, et al discloses a smoking device which includes a central foil tube filled with tobacco with the central tube surrounded by a cylinder of tobacco. The cylinder is wrapped by a porous paper wrapper. A nucleating chamber is located at one end of the smoking article to receive the smoke.

In another example, European Patent Application No. 0 245 732 filed Feb. 5, 1987 by R. J. Reynolds Tobacco Company discloses a smoking article having a dual burn rate fuel element. The element is made of a molded or extended carbon prepared from pyrolyzed cotton fiber. A tubular container of stainless steel is centrally located in the fuel element filled with a thermally stable, porous material such as porous carbons, graphite, ceramics, glass, alumina and clays. The porous material in the tubular container includes an aerosol forming substance. A seal having a central surface therethrough is located at the end of the fuel element which seals the end of the fuel element and the orifice is aligned with the tubular capsule.

Various smoking articles having a fuel column with a tubular member therethrough are shown in the following patents: U.S. Pat. No. 3,356,094 issued on Dec. 5, 1967 to C. D. Ellis, et al; U.S. Pat. No. 4,340,072 issued on Jul. 20, 1982 to Bolt, et al; U.S. Pat. No. 4,714,082 issued on Dec. 22, 1987 to Chandra K. Banerjee, et al; U.S. Pat. No. 4,715,389 issued on Dec. 29, 1987 to Dwo Lynn, et al; and, U.S. Pat. No. 4,732,168 issued on Mar. 22, 1988 to James L. Resce, et al.

SUMMARY OF THE INVENTION

The present invention provides a smoking article having a cylindrical tobacco rod circumscribed by a metalic foil, a cylinder of carbon fuel surrounding the wrapped tobacco rod, an air permeable wrapper circumscribing the cylinder of carbon fuel, and a filter plug coaxially located at one end of the tobacco rod and surrounding said cylinder of carbon fuel.

BRIEF DESCRIPTION OF THE DRAWINGS

A better understanding of the present invention will be had upon reference to the following description in conjunction with the accompanying drawings wherein.

DETAILED DESCRIPTION OF THE EMBODIMENTS

Figure 1:
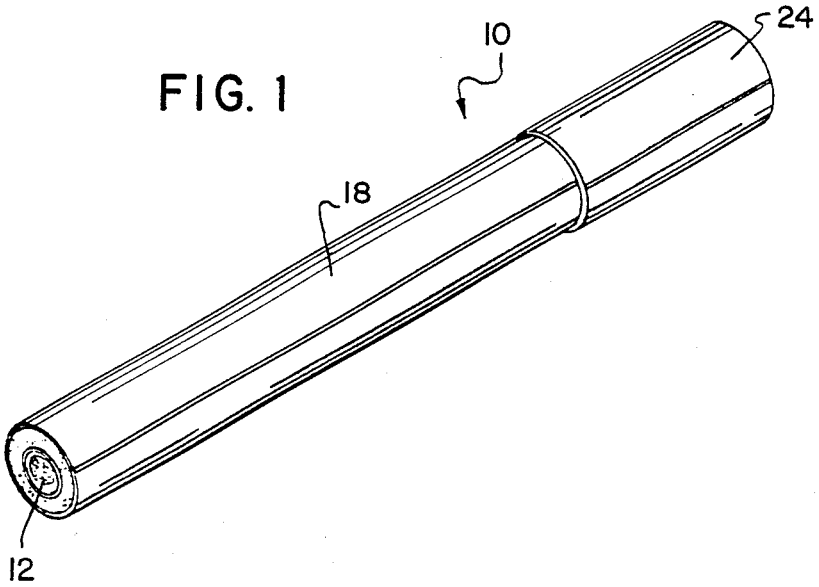
FIG. 1 is a perspective view of a smoking article of the present invention.

With reference to FIG. 1, there is shown a perspective view of a smoking article, generally denoted by the numeral 10, of the present invention which resembles a conventional cigarette in outward appearance.

Figure 2:
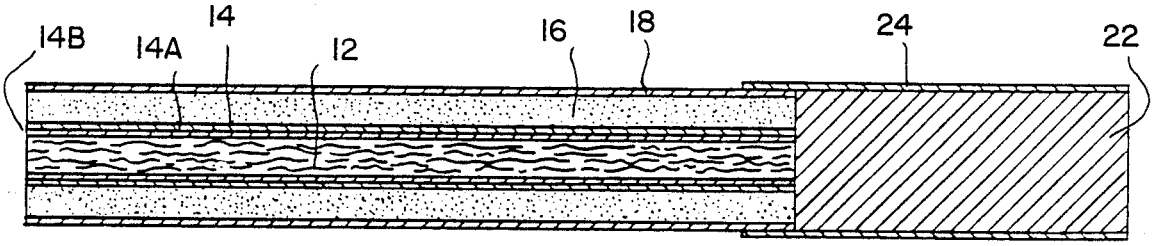
FIG. 2 is a longitudinal cross-sectional view of the smoking article of FIG. 1; and, FIG. 3 is a longitudinal cross-section view of the smoking article of FIG. 1.
Figure 3:
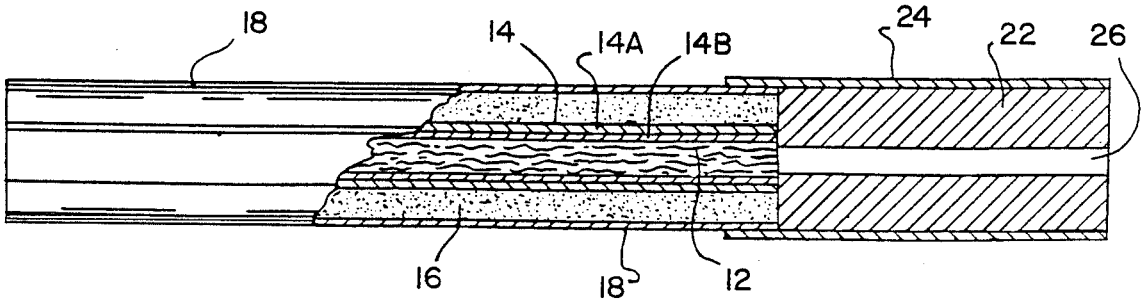

With reference to FIGS. 2 and 3, and continued reference to FIG. 1, the smoking article 10 comprises a tobacco rod 12 with a metallic foil 14 circumscribing the tobacco rod 12. A cylinder of a non-tobacco fuel 16 surrounds the metal foil wrapper tobacco rod 12 and extends along the entire length of the tobacco rod 12. The fuel cylinder 16 has an air permeable circumscribing wrapper 18. A filter plug 22 is located at one end (the mouth end) of the fuel cylinder 16 and is attached to the fuel cylinder 16 by a wrapper of tipping material 24 circumscribing the filter plug 18 and circumferentially overlapping the wrapped fuel cylinder at the end thereof adjacent the filter plug 22.

The tobacco rod 12 has preferably a circumference with the range of 10 mm to 19 mm with a packing density within the range of 100 mg per $cm^3$ to 300 mg per $cm^3$.

The metallic foil 14 is preferably a laminate including a layer of paper 14A and a layer of aluminum 14B. The laminated foil 14 is disposed with the aluminum layer in juxtaposition with the tobacco rod 12.

The non-tobacco fuel cylinder 16 is preferably a charcoal in the form of, for example, a carbon cloth, carbon felt, or molded or extruded carbon.

The circumscribing wrapper 18 around the fuel cylinder 16 is air permeable and can be either a non-combustible or a combustible material. For example, the circumscribing wrapper 18 can be fabricated of a non-combustible ceramic or treated paper. Alternatively, the circumscribing wrapper can be air permeable combustible paper material. The air permeable wrapper 18 provides for the flow of ambient air therethrough into the non-tobacco fuel cylinder 16 to support combustion of the non-tobacco fuel.

The filter plug 22 shown in FIG. 2 has an outside circumference substantially the same as the outside circumference of the non-tobacco fuel cylinder 16 and is coaxially located with the fuel cylinder 16. The filter plug 22 is in flow communication with both the non-tobacco fuel cylinder 16 as well as the tobacco rod 12.

The filter plug 122 shown in FIG. 3 has an outside circumference substantially the same as the outside circumference of the non-tobacco fuel cylinder 16 and is coaxially located with the fuel cylinder 16. Further, the filter plug 122 is formed with a cylindrical passageway 26 coaxial therethrough and has a circumference no larger than the circumference of the tobacco rod 12 so that the passageway 26 communicates only with the tobacco rod 12. The filter plug 122 with the passageway 26 therethrough is in flow communication with the non-tobacco fuel cylinder 16.

The tipping material 24 can be either air impermeable, or air permeable to provide for the flow of ambient air into the filter plug 22 to dilute the smoke flowing through the filter plug 22.

In use of the smoking article 10, the non-tobacco fuel cylinder 16 combusts or burns and the heat from the burning non-tobacco fuel cylinder 16 is transferred through the foil 14 to the tobacco rod 12 to heat the tobacco rod 12. The tobacco of the rod 12 chars, but does not combust after the lighting puff.

The foregoing detailed description is given primarily for clearness of understanding and no unnecessary limitations are to be understood for modification will become obvious to those skilled in the art upon reading this disclosure and may be made without departing from the scope of the invention or scope of the appended claims.

What is claimed is:

1. A cigarette comprising:

a tobacco rod;

a metallic wrapper circumscribing the tobacco rod;

a cylinder of carbon fuel surrounding the metallic wrapped tobacco rod;

an air permeable wrapper circumscribing the cylinder of carbon fuel; and, a filter plug coaxially located at one end of the tobacco rod and surrounding cylinder of carbon fuel, the filter plug having a cylindrical passageway therethrough in longitudinal alignment with the tobacco rod, said carbon fuel in flow communication with said filter plug.

2. The cigarette of claim 1, wherein the metallic wrapper is fabricated of aluminum foil.

3. The cigarette of claim 2, wherein the aluminum foil wrapper is a laminate comprising a paper layer and an aluminum layer, the wrapper being disposed with the aluminum layer in juxtaposition with the tobacco rod.

4. The cigarette of claim 1, wherein the tobacco rod has a circumference in a range of 10 mm to 19 mm.

5. The cigarette of claim 1, wherein the air permeable wrapper circumscribing the cylinder of carbon fuel is non-combustible.

6. The cigarette of claim 5, wherein the air permeable, non-combustible wrapper is fabricated of a treated paper.

7. The cigarette of claim 1, wherein the air permeable wrapper circumscribing the cylinder of carbon fuel is combustible.

8. The cigarette of claim 7, wherein the air permeable wrapper circumscribing the cylinder of carbon fuel is fabricated of paper.

9. The cigarette of claim 8, wherein said cylindrical passageway therethrough is coaxial with the tobacco rod, and has a circumference no larger than the circumference of the tobacco rod.

10. The cigarette of claim 1, further comprising an air impermeable tipping material circumscribing the filter plug and circumferentially overlapping the wrapped fuel cylinder at the end thereof adjacent the filter plug.

* * * * *